US005434560A

United States Patent [19]

King et al.

[11] Patent Number: 5,434,560

[45] Date of Patent: Jul. 18, 1995

[54] SYSTEM FOR DETECTING RANDOM EVENTS

[75] Inventors: John D. King, St. Paul; Richard A. Kevitt, Apple Valley, both of Minn.

[73] Assignee: Detector Electronics Corporation, Minneapolis, Minn.

[21] Appl. No.: 62,803

[22] Filed: May 11, 1993

[51] Int. Cl.[6] ..... G08B 17/12

[52] U.S. Cl. ..... 340/578; 340/577; 340/600

[58] Field of Search ..... 340/578, 577, 600; 250/395; 307/231, 517

[56] References Cited

U.S. PATENT DOCUMENTS 5,006,710 4/1991 Powell ..... 340/578
5,012,226 4/1991 Love ..... 340/578
5,077,550 12/1991 Cormier ..... 340/578

FOREIGN PATENT DOCUMENTS 1179029 1/1970 United Kingdom .
2007000A 10/1977 United Kingdom .

*Primary Examiner*—John K. Peng
*Assistant Examiner*—Albert K. Wong
*Attorney, Agent, or Firm*—Palmatier, Sjoquist & Helget

[57] ABSTRACT

A system for detecting randomly occurring signals, particularly signals representative of a fire condition, having a radiation detector for receiving the signals, peak detector circuits for identifying the peak values of the received signals, peak duration signals for determining the time between adjacent peak signals, and a collection buffer for accumulating values representative of successive peak durations. The peak duration times are compared and evaluated to determine whether regularly occurring patterns of the received signals exist, or whether the received signals are randomly occurring, and an output signal is generated whenever the comparison indicates that the received signals are random in nature.

9 Claims, 4 Drawing Sheets

SYSTEM FOR DETECTING RANDOM EVENTS

BACKGROUND OF THE INVENTION

The invention relates to the detection of random events in certain frequency domains, such as the detection of a fire. Embodiments of the invention to be described have improved discrimination against non-fire sources of varying radiation which might be confused with radiation emitted by fire, wherein the non-fire sources are characterized by repeating signal patterns.

In optical fire detectors which use flame flicker signals as a basis for the detection strategy, problems can arise with some types of bright sources which are readily confused with genuine flames. For instance, in the infrared band, radiant electric heaters send a continuous (DC) source of energy which normally falls outside the flicker band width of the flame detector unit. If some object happens to interrupt the light beam falling on the flame detector, the change in the signal level can be misinterpreted as a signal in the flicker band of the fire detector. In this case, the radiant heater could be considered to have been chopped by the interruption. Regular patterns of such interruptions can easily be the cause of false alarms.

Previously, methods have been worked out to analyze the putative fire signal to ensure that the signal meets certain statistical criteria which verify the randomness of the signal. For instance, U.S. Pat. No. 5,006,710 describes a method based on analysis of the turning points of the fire signal. By analyzing the amplitude of the signal between two turning points, a computation can be performed which distinguishes between a random signal (a property of most flames) and repetitive signals (a property of false signals). The computation is based on the amplitudes of the flicker peaks. A repetitive signal generates peak amplitudes of very similar height. The specified computation allows very different results to be generated when random peaks are used as inputs.

In practice, the performance of this amplitude analysis is not totally satisfactory. Testing with real false alarm sources show that the computation is easily fooled. For instance, if the repetitive signal consists of two or more peaks of differing heights, the algorithm will tend to call the signal random. Alternatively, if a flashing test lamp is held in front of a flame detector, the tester's involuntary muscle movement will cause amplitude modulation of the beam as it falls on the detector. This movement can cause the amplitude algorithm to misbehave.

This shortcoming can be overcome if the time between peak values, or turning points, rather than the amplitude between turning points is analyzed. A random signal has the time between turning points at random intervals. A repetitive signal repeats the time between turning points in a pattern which can be readily detected. Patterns repeat with a differing number of peaks. Three turning points is the shortest pattern. Longer patterns with 4, 5, 6 or more turning points can be described. The disclosed invention describes an improved apparatus and method of determining the existence of a randomly varying signal from a radiation source to permit the apparatus to communicate a warning indicating the presence of a fire.

SUMMARY OF THE INVENTION

According to the invention, there is provided a system for processing signals so as to discriminate in favor of a certain type of signal and against other types, comprising means for measuring durational time interval differentials between peak values, or turning points, of the signal.

The calculation is made on a group of peaks. As peaks are detected, the peak durations, i.e., measured time between peaks, are entered into a "first-in first-out buffer" (FIFO), preferably as a logarithmic value. Preferably, when seven peak durations have been collected, the "ones" calculation begins while the peak duration collection continues. The "ones" calculation compares the timing difference of every adjacent peak (buffer spacing of one). When further peaks have been collected, the "twos" calculation is made using every other peak duration in the FIFO. As the buffer continues to fill, at a later peak, the "threes" calculation is begun using every third peak duration. This process is continued for the "fours" and the "fives" etc.

Testing has shown that the "sixes" appears to be a practical limit for use in a fire detection system. In order for the signal to be declared random, all six of the calculations must simultaneously be indicative of sufficient randomness, within a predetermined threshold variation.

BRIEF DESCRIPTION OF THE DRAWINGS

Flame detection apparatus embodying the invention will now be described, by way of example only, with reference to the accompanying drawings in which.

DESCRIPTION OF THE PREFERRED EMBODIMENT

The present invention involves the collection and processing of peak durations over an extended time base consisting of a number of sequential peak durations. For purposes of illustrating the construction and operation of the invention, a preferred embodiment will be described with reference to the processing of the category of peak durations; it should be understood that the principles described herein are applicable to lesser or greater numbers of categories of peak durations, and the numbers selected herein as representing the preferred embodiment is selected merely for teaching the principles of the invention.

Figure 1A:
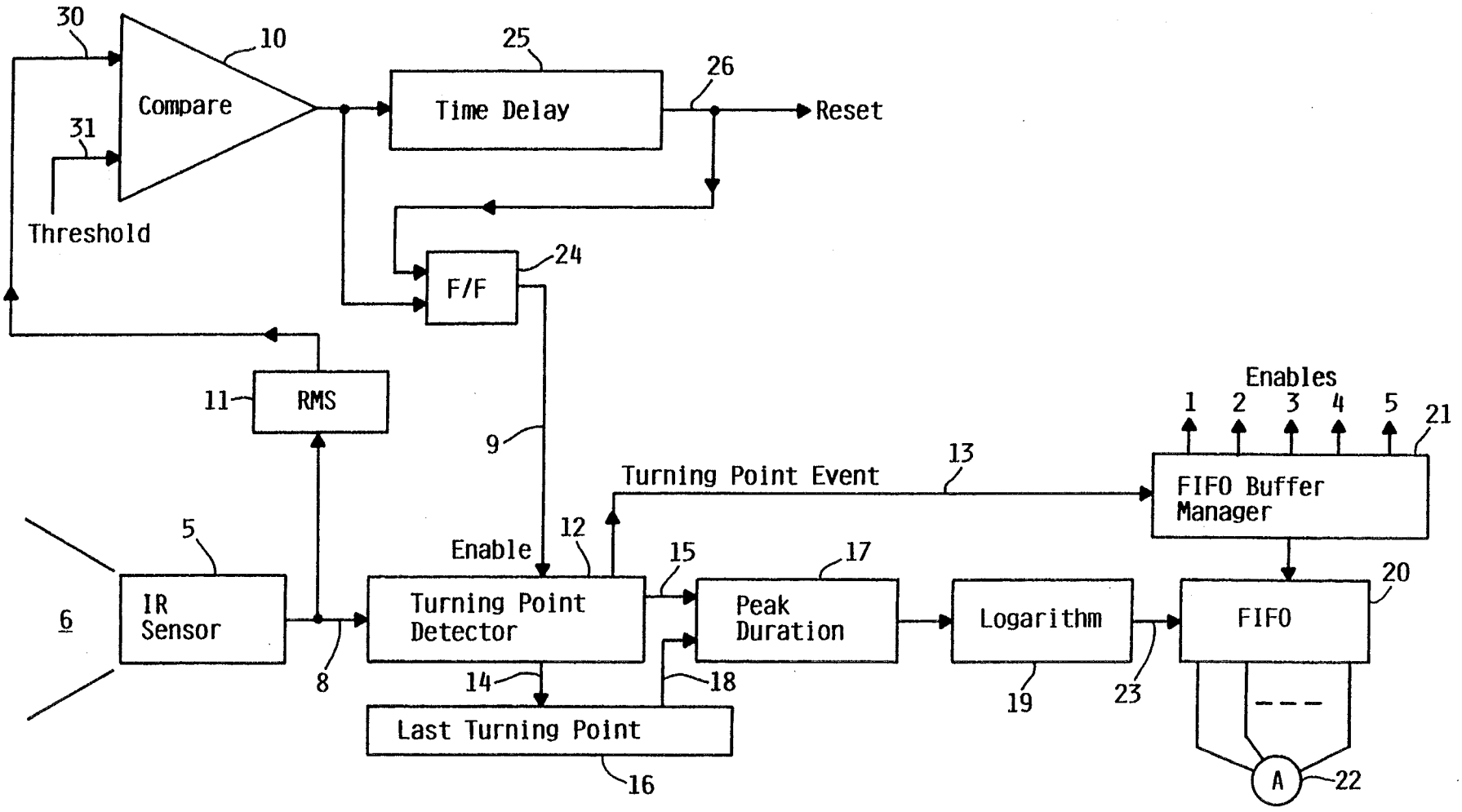
FIGS. 1A and 1B are functional block diagrams of the apparatus.

As shown in FIG. 1A, the apparatus includes an infrared radiation detector 5, such as a pyroelectric detector, which is arranged to view the area 6 in which flames to be detected are expected to arise. The detector 5 may view the area 6 through a suitable radiation filter if required. In a specific example being considered, the detector may be arranged to be responsive to infrared radiation at about 4.3 micrometers and produces a corresponding electrical signal on a line 8 which is passed to a turning point detector (peak detector) 12. The output from RMS circuit 11 is coupled as one of the two inputs into the comparator 10. The other input into comparator 10 is a "threshold" voltage value, which is set to a predetermined voltage, which may be empirically determined, comparator 10 will deliver an output signal whenever the RMS voltage input exceeds the threshold input, thereby indicating that IR sensor 5 is detecting more than merely a nominal level of radiation. Radiation levels which produce an RMS voltage output from circuit 11 below the threshold value are considered to be caused by noise, and are therefore ignored by the system. Other forms or types of signal detector, other than RMS detector 11, could be used in substitution of an RMS detector; for example, a peak voltage detector.

Turning point detector 12 has an "enable" input via line 9 from a comparator 10. The output of comparator 10 is fed into a time-delay circuit 25 and a flip-flop circuit 24. Time delay circuit 25 has the characteristic that it will generate a "reset" signal on its output line 26 a predetermined time after it no longer receives an input signal from comparator 10. This "reset" signal is transmitted to the various circuits shown in FIG. 1A and FIG. 1B, for the purpose of initializing all of the circuits in preparation for receiving a new sequence of signals from the IR sensor 5. The "reset" signal from time-delay circuit 25 is also transmitted to flip-flop circuit 24 to disconnect the "enable" signal on line 9. The "enable" signal on line 9 becomes active as soon as an output signal appears from comparator 10, and remains active until the "reset" signal is received from time-delay circuit 25. The signal on line 9 is an "enable" signal to the turning point detector 12, thereby permitting the turning point detector 12 to become engaged. The output signal from IR sensor 5 is also connected as an input to RMS circuit 11. RMS circuit 11 may take the form of an integrating circuit, or any other type of circuit which can develop an output signal representative of the average or RMS voltage level output from IR sensor 5.

Once the turning point detector 12 has become engaged, it continuously monitors the input signal on line 8 and when a turning point is detected in the value of that signal it generates a "turning point event" signal on line 13 and a time signal on lines 14 and 15. The time signal on line 14 may be developed from a conventional clock circuit, and is stored in a "last turning point" buffer 16, and the last previous-stored time signal is transferred to the peak duration circuit 17 via line 18. The peak duration circuit 17 calculates the difference between the two input time signals on lines 15 and 18, and transfers this result to logarithm circuit 19. Logarithm circuit 19 creates the logarithmic value of this input, using any convenient logarithmic base, and transfers this value to the first-in first-out (FIFO) buffer 20. The FIFO buffer 20 comprises a predetermined number of stages of memory cells arranged in sequential order. The data contained in these memory cells may be sequentially shifted through the FIFO, and each time a new logarithmic value is output from logarithm circuit 19 via line 23, this new value is input into the first memory cell of the FIFO buffer 20, and all previous logarithmic values stored in the subsequent memory cells are shifted one position to accommodate the new value. The last logarithmic value in FIFO buffer 20 is discarded, so that at any given instant in time the FIFO buffer memory cells are sequentially loaded with logarithmic values chronologically arranged. In various embodiments, the FIFO buffer may contain upwards of 10–50 sequential memory cells for purposes to be hereinafter described.

The FIFO buffer manager circuit 21 receives the "turning point event" signal as a gating signal via line 13 from the turning point detector 12, each time a new turning point is detected. This causes the FIFO buffer manager circuit 21 to generate a gating signal to the FIFO buffer 20, thereby causing the sequential shifting operation described above, and also generates gating signals over the five "enable" lines which are shown as outputs 1–5 from the FIFO buffer manager 21.

The output of the peak duration circuit 17 is a signal "PD" having a value corresponding to the time interval between two adjacent peaks. The value of peak duration corresponding to the time between the first two adjacent peaks is $PD_1$; the value for the peak duration corresponding to the time between the second and third peaks is $PD_2$; the value corresponding to the time interval between any two adjacent peaks is $PD_n$. The $PD_n$ values are sequentially input into the logarithm circuit 19 to produce corresponding logarithmic values; i.e., the logarithmic value $L_1$ corresponds to $PD_1$, the logarithmic value $L_2$ corresponds to $PD_2$ . . . the logarithmic $L_n$ corresponds to $PD_n$. The logarithmic values $L_1$, $L_2$, . . . $L_n$ are sequentially fed into the memory cells of FIFO buffer 20 for subsequent processing.

Figure 1B:
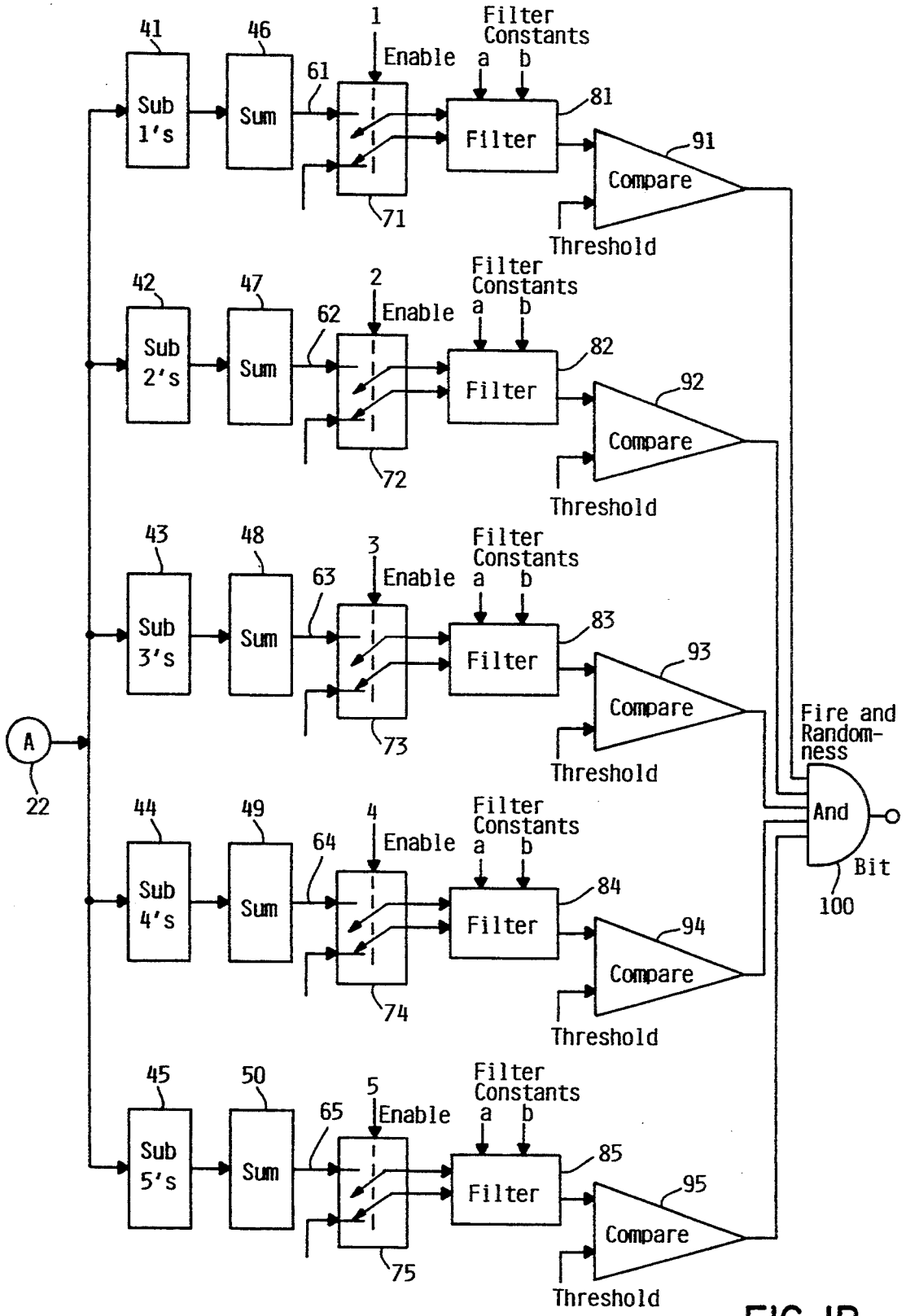

The logarithmic values held in the various memory cells of FIFO buffer 20 are connected via lines 22 into a plurality of groups of subtraction circuits 41–45, as shown in FIG. 1B. These groups of circuits are respectively identified as the "ones," "twos" "threes," "fours," "fives" subtraction circuit groups. The subtraction circuits within each subtraction circuit group are subsequently connected to a sum circuit; i.e., subtraction circuit group 41 connected to sum circuit 46, subtraction circuit group 42 connected to sum circuit 47, etc. Each of the sum circuits 46–50 respectively forms the sum of the values developed by the plurality of subtraction circuits within each of the subtraction circuit groups, and the summation output signals are respectively presented on lines 61–65. Lines 61–65 are respectively connected as input lines to switching circuits 71–75, and the outputs from switching circuit 71–75 are respectively connected to filter circuits 81–85. The outputs from filter circuits 81–85 are respectively connected to comparators 91–95. The outputs from comparators 91–95 are all connected into an "AND" circuit 100, and the output from "AND" circuit 100 is representative of an alarm signal, to indicate the presence of a randomly occurring input radiation signal, which is usually indicative of the presence of a fire.

Figure 2:
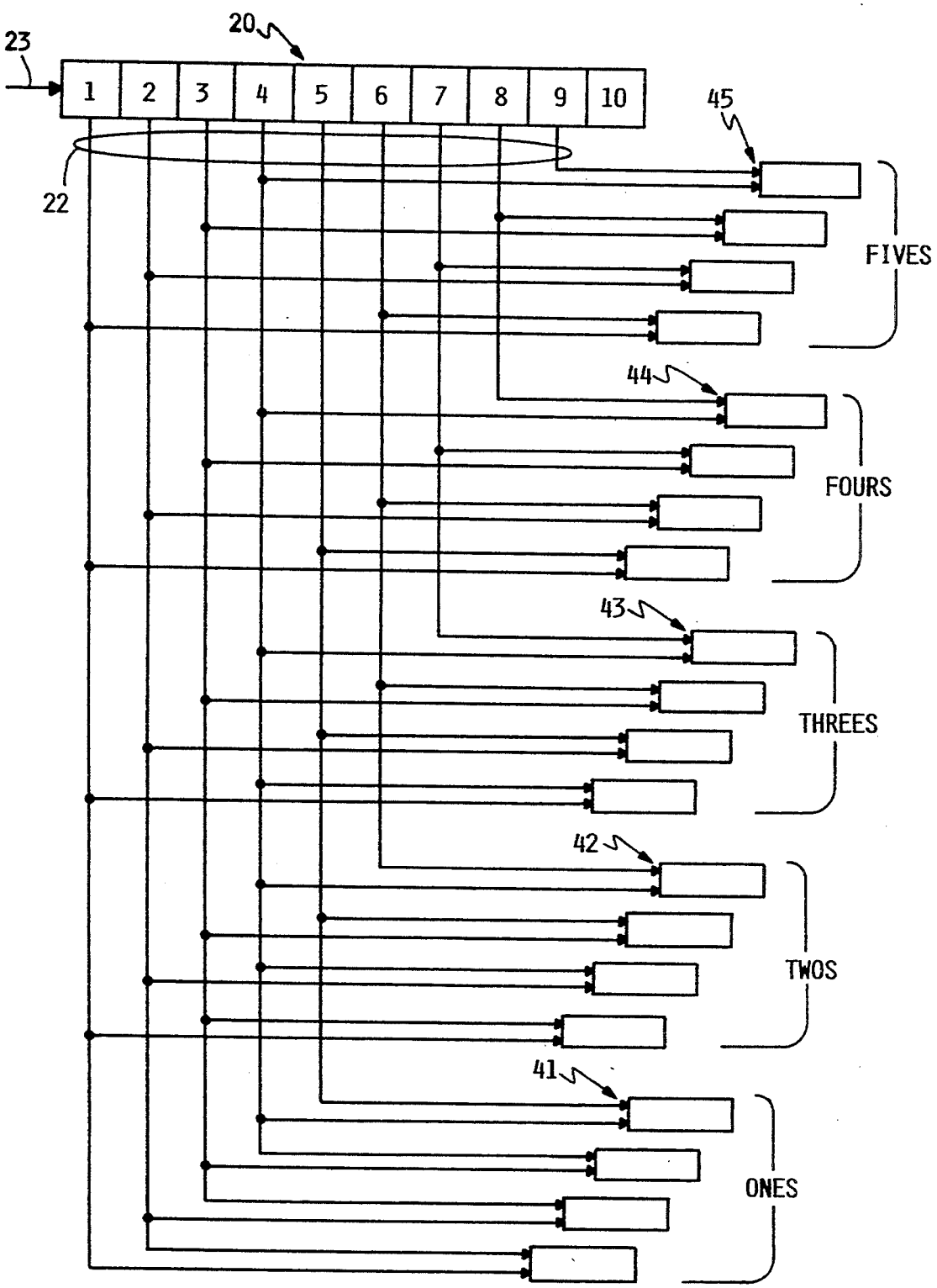
FIG. 2 shows a functional block diagram of the FIFO and the subtraction circuits.

FIG. 2 shows a functional block diagram of FIFO buffer 20 and the groups 41–45 of subtraction circuits connected thereto. For purposes of this illustration FIFO buffer 20 is shown as having ten consecutive memory cells, with the sequential logarithmic values $L_1$–$L_{10}$ input into FIFO buffer 20 via line 23. The output lines 22 from FIFO buffer 20 are connected to the respective subtraction circuit groups 41–45, with specific memory cells of FIFO buffer 20 connected to specific subtraction circuit groups. In particular, FIFO buffer 20 memory cells 1–2, 2–3, 3–4, and 4–5 are connected to subtraction circuit group 41. Further, memory cells 1–3, 2–4, 3–5, and 4–6 are connected to subtraction circuit group 42. Further, memory cells 1–4, 2–5, 3–6, and 4–7 are connected to subtraction circuit group 43. Further, memory cells 1–5, 2–6, 3–7, and 4–8 are connected to subtraction circuit group 44. Further, memory cells 1–6, 2–7, 3–8, and 4–9 are connected to subtraction circuit group 45. In particular embodiments of the invention FIFO buffer 20 may be enlarged or contracted, and the number of subtraction circuit groups may be correspondingly expanded or contracted. In addition, greater or lesser numbers of memory cells from FIFO buffer 20 may be connected to corresponding subtraction circuits within the subtraction circuit groups.

Figure 3:
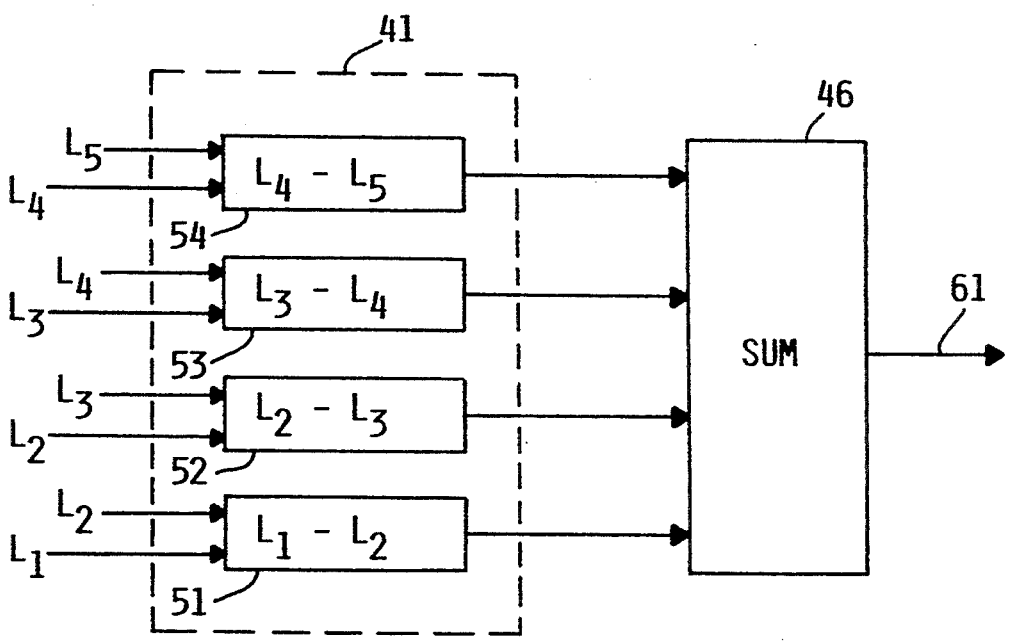
FIG. 3 is a functional block diagram of the summation of the "ones" subtraction.

FIG. 3 shows a functional block diagram which is representative of all of the subtraction circuit group connections. For convenience, FIG. 3 shows the connections for subtraction circuit group 41, and its connections to sum circuit 46. For convenience the logarithmic values are identified as inputs to subtraction circuit group 41. Subtraction circuit group 41 includes four subtraction circuits 51–54. Subtraction circuit 51 receives logarithmic values $L_1$ and $L_2$, and forms the difference ($L_1$–$L_2$); subtraction circuit 52 receives the logarithmic values $L_2$ and $L_3$, and forms the difference ($L_2$–$L_3$); subtraction circuit 53 receives the logarithmic values $L_3$ and $L_4$ and forms the difference ($L_3$–$L_4$); and subtraction circuit 54 receives the logarithmic values $L_4$ and $L_5$ and forms the difference ($L_4$ –$L_5$). All of the respective different signals are connected to summing circuit 46, which forms the summation of these values and presents it at its output line 61.

Since each of the subtraction circuits performs a subtraction of logarithmic values, the result is a logarithm of the ratio of the values. For example, the logarithmic difference ($L_1$–$L_2$) is a logarithmic value representing the ratio $PD_1/PD_2$, which is the ratio of the first two peak durations. Although the specific overall purpose of the invention is to identify identical or substantially identical peak durations, the same purpose is accomplished by forming ratios of peak durations and identifying ratios which are identical or substantially identical. Furthermore, the use of peak duration ratios tends to normalize the overall process; i.e., regularly occurring peaks which are widely spaced in time will provide the same ratio as regularly occurring peaks which are closely spaced in time. Therefore, the use of ratios rather than peak duration values provide a normalized result which is useful for all bandwidths of peak times. If two sequential peak durations are substantially equal, their difference will be zero and the ratio will be 1; however, the logarithmic calculation will produce a logarithmic value of zero, which can then be introduced into the sum logic as a zero value, which is indicative of regularly occurring peak durations.

In appropriate circumstances, the functional block diagrams represented in FIGS. 2 and 3 may be constructed according to digital circuit design techniques, wherein all of the values are represented by binary number values, and the summation values are respectively represented by binary numbers. Alternatively, the functional block diagrams of FIGS. 2 and 3 may be implemented by analog circuits, wherein the respective values are analog voltages, and the respective sums are also analog voltages. As a further alternative, the functional block diagrams of FIGS. 2 and 3 may be entirely implemented by software within a programmed computer, wherein the respective combinations and calculations are performed by software and the summation values are formed as a result of the execution of an appropriate software program.

The respecting switching circuits 71–75 are activated by enable signals 1–5, which are respectively transmitted as output signals from FIFO buffer manager 21. The enable signals 1–5 are each generated when the FIFO buffer manager circuit 21 senses that the appropriate memory cells within FIFO buffer 20 have been filled with information from logarithm circuit 19. For example, enable "one" from FIFO buffer manager 21 is transmitted whenever FIFO buffer memory cells 1–5 have been filled with logarithm values from logarithm circuit 19. Enable signal "two" is generated when FIFO buffer manager circuit 21 detects that memory cells 1–6 have been loaded with logarithmic values from logarithm circuit 19; enable signal "three" is generated whenever FIFO buffer manager circuit 21 senses that FIFO buffer memory cells 1–7 have been loaded with logarithmic values from logarithm circuit 19; enable "four" is generated whenever FIFO buffer manager circuit 21 senses that memory cells 1–8 within FIFO buffer 20 have been loaded with logarithmic values from logarithm circuit 19; and enable "five" is generated whenever FIFO buffer manager circuit 21 senses that memory cells 1–9 have been loaded with logarithmic values from logarithm circuit 19. The occurrence of each "enable" signal causes the respective switching circuit to which it is connected to activate, thereby conveying the "sum" output signal from the respective summer to the filter circuit connected to the switching circuit. For example, the presence of an enable "one" signal causes switching circuit 71 to activate, thereby connecting signal line 61 to the input of filter 81.

Figure 4:
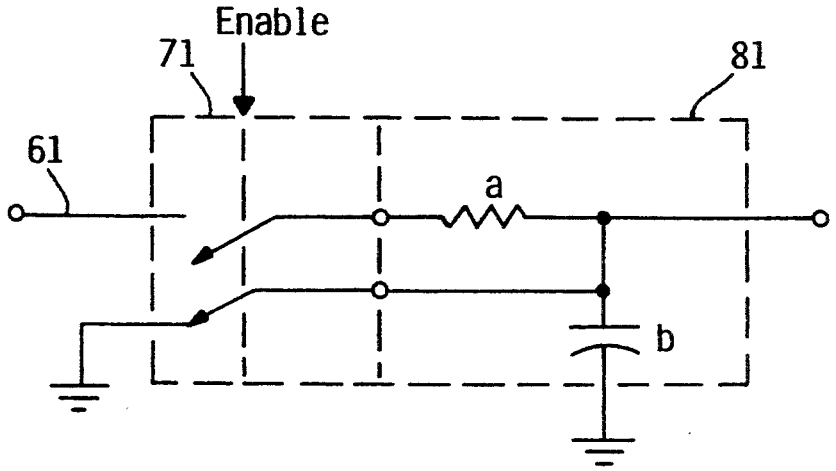
FIG. 4 is an equivalent schematic diagram of the filter circuit of the invention.

The primary purpose of filter 81 is to provide an average output signal which is adjusted over time, wherein the timed average is controllable by selection of two filter constants "a" and "b"; i.e., the magnitude of the summation signal from each summer 46, 47, . . . which is presented as an input signal to the respective compare circuits is a controlled time-average signal. Each filter thereby permits a relative weighting to be given to the respective summer signals, by reducing the earliest-arriving summer signals by a larger factor than the subsequent arriving summer signals. In a preferred embodiment, the filters 81, 82, . . . may be real-time digital filters, designed according to techniques which are well known in the art. For example, filters of this general type are described in the book entitled *Real Time Programming*, Caxton C. Foster, Addison-Wesley Publishing Company (1981) at pages 86–106. A further example of digital filters is described in the article entitled "Finite Impulse Response Filters," Stephen E. Bialkowski, *Journal of Analytical Chemistry*, Vol. 60, No. 5, Mar. 1, 1988 (pages 355–361). The filter constants "a" and "b" are selectable values which determine the relative degree of filtering, i.e., the amount of timed average weighting to be given to the respective summer signals. Another way of looking at the filter circuits is in analog form as represented in FIG. 4, which shows a representative schematic diagram of a type of R-C time constant filter. The time constant of the filter is determined by the magnitude of the resistor "a" and the capacitor "b" which are connected to receive the output from summer 46 via switching circuit (relay) 71. FIG. 4 represents a schematic equivalent diagram to illustrate the function of filter 81. Initially, the voltage charge across capacitor "b" is discharged to ground, so that when the "enable" signal is applied to relay 71 the "sum" signal on line 61 is applied across resistor "a." A finite time later, determined by the magnitudes of "a"

and "b," the output signal rises to a level equal to the "threshold" value input into compare circuit 91, which may be empirically determined. At this point compare circuit 91 provides an output signal to AND gate 100, indicating that at least one of the conditions for determining the presence of a fire has been met. If all of the other compare circuits 92–95 have received similar threshold-exceeding signals from their filters, all of the compare circuit outputs will also generate signals indicative of a fire condition, and the AND gate 100 will present an output signal indicative of fire. The output signal may be applied to a suitable alarm of other indicator, thereby providing a fire negation signal.

In operation, the IR sensor continually monitors a defined field of view, and is responsive to signals in a predefined bandwidth which has been chosen particularly for the intended monitoring operation. If the IR sensor is intended for fire detection the predefined bandwidth is one or more wavelength ranges for which flames contribute a relatively high energy content. When the energy level received by the IR sensor exceeds a predetermined level, as dictated by the RMS circuit and the threshold value of comparator 10, the turning point detector circuits are enabled. These circuits will stay enabled for so long as the energy level of the received signals continues to exceed the predetermined threshold. During the time in which the turning point detector is activated it continually monitors the received signal waveform, recording the time at which each peak value is detected. The respective times of two successive peak values are converted into a time value by the peak duration circuits, and this value is converted into a logarithmic value by the logarithm circuit. Consecutive logarithmic values are collected by the FIFO circuits, and the subtracters perform the respective subtraction calculations as the FIFO values continue to be accumulated. The subtraction results from a plurality of subtracter circuits are collected into a summer, and the sum of these results is passed into a filter. After filtering, the resultant value is conveyed to one of the output comparators to be compared against another predetermined threshold. If the comparison exceeds the predetermined threshold a signal is transmitted to the output AND gate, and a fire alarm signal is generated by the AND gate whenever all of the output comparators provide a positive output signal. The fire alarm signal may be conveyed to a visible or audible alarm, a fire suppression system, or any other output device designed to respond to the fire alarm. Intermittent fire signals which may be received by the IR sensor are suppressed by the time delay circuit which resets all of the circuits a predetermined time after the input energy level has dropped below the requisite reference level.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for detecting random signals from a sequence of signals including both random and nonrandom signals, each of said signals having a signal peak occurring at a measurable time of occurrence, comprising:

a) means for identifying the time of occurrence of signal peaks for each signal in said sequence of signals;

b) means for measuring the time between successive identified times of occurrence of said signals; and means for converting the measured times between signals to logarithmic values, thereby creating successive logarithmic measured times;

c) means for storing the logarithmic measured times in chronological order to form a sequence of logarithmic measured times $T_1$, $T_2$, $T_3$, . . . $T_{1+n}$, $T_{1+2n}$, . . . $T_{1+nn}$, where n is an integer;

d) means, connected to said means for storing, for comparing the respective logarithmic measured times $T_1$, $T_2$, $T_3$, . . . and for generating a 1's output signal when all said compared times are unequal;

e) means, connected to said means for storing, for comparing the respective logarithmic measured times $T_1$, $T_3$, $T_5$, . . . and for generating a 2's output signal when all said compared times are unequal;

f) means, connected to said means for storing, for comparing the respective logarithmic measured times $T_1$, $T_4$, $T_7$, . . . and for generating a 3's output signal when all said compared times are unequal;

g) means, connected to said means for storing, for comparing the respective logarithmic measured times $T_1$, $T_{1+n}$, $T_{1+2n}$, $T_{1+3n}$, . . . and for generating an n's output signal when all said compared times are unequal; and h) means for generating an alarm signal when said 1's output signal and said 2's output signal and said 3's output signal and said n's output signal are all present.

2. The apparatus of claim 1, wherein each said means for comparing the logarithmic values of said measured times further comprises means for subtracting the logarithmic measured times $T_1$–$T_2$, $T_2$–$T_3$, $T_3$–$T_4$, . . . ; and means for subtracting the logarithmic measured times $T_1$–$T_3$, $T_2$–$T_4$, $T_3$–$T_5$, . . . ; and means for subtracting the logarithmic measured times $T_1$–$T_4$, $T_2$–$T_5$, $T_3$–$T_6$, . . . ; and means for subtracting the logarithmic measured times $T_1$–$T_{1+n}$, $T_2$–$T_{1+2n}$, $T_3$–$T_{1+3n}$, . . .

3. The apparatus of claim 2, wherein each said means for comparing further comprises means for summing the respective logarithmic subtraction results of $T_1$–$T_2$, $T_2$–$T_3$, . . . ; and means for summing the respective logarithmic subtraction results of $T_1$–$T_3$, $T_2$–$T_4$, . . . ; and means for summing the respective logarithmic subtraction results of $T_1$–$T_4$, $T_2$–$T_5$, . . . ; and means for summing the respective logarithmic subtraction results of $T_1$–$T_{1+n}$, $T_2$–$T_{1+2n}$, $T_3$–$T_{1+3n}$, . . .

4. The apparatus of claim 3, wherein said means for generating an alarm signal further comprises means for generating an alarm signal when each of said means for summing respectively produce a result which exceeds a predetermined threshold value.

5. A radiation detection apparatus for detecting randomly occurring successive radiation signals having respective peak values, in a defined field of view, comprising:

a) a radiation detector positioned to monitor said field of view, said detector having means for generating successive electrical signals having peak values responsive to said successive radiation signals' peak values;

b) means for measuring the time between successive ones of said electrical signals' peak values; thereby creating successive measured times;

c) means for converting said successive measured times to logarithmic values L, and means for chronologically storing respective ones of said logarithmic values in the form $L_1$, $L_2$, $L_3$, . . . ; where n is an integer;

d) means for selectively subtracting said logarithmic values in groups, wherein adjacent logarithmic values $L_1$–$L_2$, $L_2$–$L_3$, . . . are subtracted to form a first group, second-spaced logarithmic values $L_1$–$L_3$, $L_2$–$L_4$, . . . are subtracted to form a second group, third-spaced logarithmic values $L_1$–$L_4$, $L_2$–$L_5$, . . . are subtracted to form a third group;

e) means for summing the results of said first group of subtractions to form a first sum, and means for summing the results of said second group of subtractions to form a second sum, and means for summing the results of said third group of subtractions to form a third sum;

f) means for comparing each of said respective first, second, third, sums against a predetermined threshold value, and generating an output signal whenever one of said sums exceeds said threshold value; and g) means for ANDing said output signals together and generating an alarm signal when all output signals are present.

6. The apparatus of claim 5, further comprising circuit monitor means connected to receive said radiation detector electrical signals, said circuit monitor means having means for generating an output gating signal when said radiation detector electrical signals exceed a predetermined threshold level; and gating means for activating said means for measuring the time between successive ones of said electrical signals' peak values, responsive to said output gating signal.

7. The apparatus of claim 6, further comprising time delay means electrically coupled to said gating means and said circuit monitor means, said time delay means operative to disable said gating means a predetermined time after said circuit monitor means ceases generating an output gating signal, said predetermined time being chosen to represent the maximum permissible time between successive radiation signals.

8. The apparatus of claim 7, further comprising filter means interposed between each of said means for summing and said means for ANDing said output signals together, each said filter means being operative to reduce said means for summing output signals.

9. The apparatus of claim 8, further comprising a plurality of enable circuits, each of said enable circuit interposed between each of said means for summing and each of said filter circuits, each of said enable circuits being responsive to said means for chronologically storing to permit said filter circuits to receive output signals from said means for summing only when all the logarithmic values associated with a respective subtraction group are stored in said means for chronologically storing.

* * * * *